US011408363B2

(12) United States Patent
Chen et al.

(10) Patent No.: US 11,408,363 B2
(45) Date of Patent: Aug. 9, 2022

(54) CONTROL METHOD, DEVICE AND STORAGE MEDIUM FOR ENGINE OPERATION

(71) Applicant: Qi'an Chen, Rui'an (CN)

(72) Inventors: Qi'an Chen, Rui'an (CN); Beiwu Jin, Rui'an (CN)

(73) Assignee: Qi'an Chen, Rui'an (CN)

( * ) Notice: Subject to any disclaimer, the term of this patent is extended or adjusted under 35 U.S.C. 154(b) by 0 days.

(21) Appl. No.: 17/214,833

(22) Filed: Mar. 27, 2021

(65) Prior Publication Data

US 2022/0042474 A1 Feb. 10, 2022

(30) Foreign Application Priority Data

Aug. 6, 2020 (CN) ..... 202010785086.9

(51) Int. Cl.

| | |
|---|---|
| ***F02D 41/14*** | (2006.01) |
| ***F02D 41/30*** | (2006.01) |
| ***F02P 5/04*** | (2006.01) |
| ***F02P 5/06*** | (2006.01) |
| ***F02P 5/14*** | (2006.01) |

(52) U.S. Cl.

CPC ..... *F02D 41/1454* (2013.01); *F02D 41/30* (2013.01); *F02P 5/045* (2013.01); *F02P 5/06* (2013.01); *F02P 5/142* (2013.01); *F02D 2200/021* (2013.01); *F02D 2200/101* (2013.01)

(58) Field of Classification Search

CPC ..... F02D 41/1454; F02D 41/30; F02D 2200/021; F02D 2200/101; F02P 5/045; F02P 5/06; F02P 5/142

USPC ..... 123/406.23

See application file for complete search history.

(56) References Cited

U.S. PATENT DOCUMENTS 4,399,789 A * 8/1983 Yano ..... F02P 5/1558 123/339.22

4,506,639 A * 3/1985 Murakami ..... F02D 31/005 123/352

2021/0095630 A1* 4/2021 Hu ..... F02N 19/10

FOREIGN PATENT DOCUMENTS

DE 102012204112 A1 * 9/2012 ..... F02D 41/1497

* cited by examiner

*Primary Examiner* — Mahmoud Gimie

(57) ABSTRACT

A control method, a control device, an electronic device and a storage medium for engine operation are provided. The method includes: obtaining a rotational speed and a temperature of an engine at a current time and determining a reference value of the control parameter of the engine based on the rotational speed and the temperature; detecting a composite operating state of the engine at the current time and determining an offset of the control parameter corresponding to each operating state in the composite operating state; adding the reference value of the control parameter and the offset of the control parameter corresponding to each operating state in the composite operating state to obtain a final value of the control parameter; and controlling the engine at the current time according to the final value of the control parameter.

19 Claims, 8 Drawing Sheets

CONTROL METHOD, DEVICE AND STORAGE MEDIUM FOR ENGINE OPERATION

CROSS-REFERENCE TO RELATED APPLICATIONS

This application claims all benefits accruing under 35 U.S.C. § 119 from China Patent Application No. 202010785086.9, filed on Aug. 6, 2020, in the China National Intellectual Property Administration, the content of which is hereby incorporated by reference.

TECHNICAL FIELD

The present disclosure generally relates to the technical field of engine fuel control, and in particular, to a control method, a device, an electronic device and a storage medium for the operation of a low-cost and light-load internal combustion engine.

BACKGROUND

An engine is a machine capable of converting other forms of energy into mechanical energy, including, for example, an internal combustion engine, an external combustion engine (Stirling engine, steam engine, etc.), a jet engine, an electric motor, etc. The engine serves as a power source for mobile devices such as automobiles, locomotives, steamships, agricultural machines (agricultural vehicles), construction machines, and military vehicles, and the engine is an indispensable core member of the mobile device, which is mainly used for consuming petroleum.

Both an engine ignition system and a fuel injection system are important components of the engine. The engine ignition system is generally composed of a battery, a generator, an electric splitter, an ignition coil and a spark plug. When the engine is in operation, the ignition moment has a great influence on the operation performance of the engine. The first ignition is a spark plug ignition before a piston reaches a compression upper stop point, igniting combustible mixed gas in a combustion chamber. Reaching the compression upper stop point from the ignition moment, the angle at which the crankshaft rotates within this period of time is referred to as an ignition advance angle. The ignition advance angle setting plays a decisive role in the power, economy and emissions of the engine. The fuel injection system is configured to precisely control an injection, an injection time, and an injection pressure of engine fuel, so that the fuel amount injected into a cylinder reaches an optimal value.

Existing engine ignition control and fuel injection system generally uses operating condition control to control the ignition advance angle and fuel injection of the engine. The current fuel injection system of the engine generally determines the operating condition according to engine operating speed, temperature and throttle load, and then calibrates the ignition and injection of a matching EFI (electronic fuel injection) system according to the engine performance level, operating conditions and combustion conditions of the operating condition.

When the engine is operating, the operating conditions handled are often a combination of multiple operating conditions. At present, no effective solution has been proposed for a problem that the engine cannot work properly when composite conditions exist in the related art.

SUMMARY

Thus, to solve the above problem in the related art at least, it is desired to provide a control method, a device and a storage medium for engine operation.

According to one aspect, the present disclosure provides a control method for engine operation. The method includes the following steps:

Obtaining a rotational speed and a temperature of an engine at a current time and determining a reference value of the control parameter of the engine based on the rotational speed and the temperature, wherein the control parameter includes at least one of an ignition angle parameter and a fuel injection parameter;

Detecting a composite operating state of the engine at the current time and determining an offset of the control parameter corresponding to each operating state in the composite operating state;

Adding the reference value of the control parameter and the offset of the control parameter corresponding to each operating state in the composite operating state to obtain a final value of the control parameter; and Controlling the engine at the current time according to the final value of the control parameter.

In some embodiments of the present disclosure, the determining a reference value of the control parameter of the engine based on the rotational speed and the temperature includes:

Obtaining a first table of preset control parameters, wherein the first table includes correspondence information among the rotational speed of the engine, the temperature of the engine, and the reference value of the control parameter of the engine; and Looking up the reference value of the control parameter under the rotational speed and the temperature in the first table.

In some embodiments of the present disclosure, the composite operating state includes a first operating state, and the determining an offset of the control parameter corresponding to each operating state in the composite operating state includes:

Obtaining a second table of preset control parameters, wherein the second table includes correspondence information among the rotational speed of the engine, the temperature of the engine, and the offset of the control parameter of the engine under the first operating state; and Looking up the offset of the control parameter corresponding to the first operating state under the rotational speed and the temperature in the second table.

In some embodiments of the present disclosure, the detecting a composite operating state of the engine at the current time includes:

Detecting a first number of revolutions from a start of the engine to the current time;

Judging whether the first number of revolutions is less than a first preset number of revolutions, wherein the first preset number of revolutions represents the number of revolutions required for the engine from the start of the engine to an exit from a start-up state; and When the first number of revolutions is less than the first preset number of revolutions, determining that the composite operating state of the engine includes the start-up state at the current time.

In some embodiments of the present disclosure, the detecting a composite operating state of the engine at the current time includes:

Determining a second preset number of revolutions corresponding to the temperature, wherein the second preset number of revolutions represents the number of revolutions required for the engine at the temperature from a start of the engine to an exit from a cold engine state;

Detecting a first number of revolutions from the start of the engine to the current time; and When the first number of revolutions is less than the second preset number of revolutions, determining that the composite operating state of the engine includes the cold engine state at the current time.

In some embodiments of the present disclosure, the detecting a composite operating state of the engine at the current time includes:

Judging whether the acceleration of the engine at the current time meets a preset accelerating threshold and whether the engine is in an accelerating state; and When the acceleration of the engine at the current time meets a preset accelerating threshold and the engine is not in the accelerating state, determining that the engine begins to enter the accelerating state.

In some embodiments of the present disclosure, after the determining that the engine begins to enter the accelerating state, the detecting a composite operating state of the engine at the current time further includes:

Detecting a second number of revolutions from entering the accelerating state to the current time;

Judging whether the second number of revolutions is greater than a third preset number of revolutions, wherein the third preset number of revolutions represents the number of revolutions required for the engine from entering the accelerating state to an exit from the accelerating state; and When the second number of revolutions is greater than the third preset number of revolutions, determining that the engine exits the accelerating state.

In some embodiments of the present disclosure, the third preset number of revolutions is determined based on the acceleration at which the engine begins to enter the accelerating state, the rotational speed at which the engine begins to enter the accelerating state, and the target rotational speed of the engine.

In some embodiments of the present disclosure, the detecting a composite operating state of the engine at the current time further includes:

When the second number of revolutions is not greater than the third preset number of revolutions, determining that the composite operating state of the engine includes the accelerating state at the current time.

In some embodiments of the present disclosure, the detecting a composite operating state of the engine at the current time and determining an offset of the control parameter corresponding to each operating state in the composite operating state further includes:

Judging whether an adaptive-adjustment instruction is received;

Upon receipt of the adaptive-adjustment instruction, determining that the engine begins to enter an adaptive-adjustment state;

Reducing a ratio of air to fuel of the engine by a first preset step until a rotational speed after the reduction is less than the rotational speed before the reduction, and a rotational speed difference between the rotational speed before the reduction and the rotational speed after the reduction is greater than a preset drop value;

Increasing the ratio of air to fuel of the engine by a second preset step until the rotational speed after the increase is less than the rotational speed before the increase, and a rotational speed difference between the rotational speed before the increase and the rotational speed after the increase is greater than the preset drop value; and Determining the offset of the control parameter corresponding to the adaptive-adjustment state according to a reduced ratio of air to fuel and an increased ratio of air to fuel.

In some embodiments of the present disclosure, the preset drop value ranges from 0-200 revolutions per minute.

According to one aspect, the present disclosure provides a control device for engine operation. The control device includes:

An obtaining module, configured to obtain a rotational speed and a temperature of an engine at a current time and determine a reference value of the control parameter of the engine based on the rotational speed and the temperature, wherein the control parameter includes at least one of an ignition angle parameter and a fuel injection parameter;

A detecting module, configured to detect a composite operating state of the engine at the current time and determine an offset of the control parameter corresponding to each operating state in the composite operating state;

A processing module, configured to add the reference value of the control parameter and the offset of the control parameter corresponding to each operating state in the composite operating state to obtain a final value of the control parameter; and A control module, configured to control the engine at the current time according to the final value of the control parameter.

According to one aspect, the present disclosure provides an electronic device, including a memory, a processor and a computer program stored on the memory and executed by the processor. The processor can execute the computer program to implement the control method for engine operation as described in the one aspect above.

According to another aspect, the present disclosure provides a storage medium on which a computer program is stored, wherein the computer program is executed by a processor to implement the control method for engine operation as described in the one aspect above.

Compared with the related art, the control method, the control device, the electronic device and the storage medium for engine operation are provided by the present disclosure. Obtaining a rotational speed and a temperature of an engine at a current time and determining a reference value of the control parameter of the engine based on the rotational speed and the temperature; detecting a composite operating state of the engine at the current time and determining an offset of the control parameter corresponding to each operating state in the composite operating state; adding the reference value of the control parameter and the offset of the control parameter corresponding to each operating state in the composite operating state to obtain a final value of the control parameter; and controlling the engine at the current time according to the final value of the control parameter. By means of the present disclosure, the problem in the related art that the engine cannot work properly when the composite conditions exist is solved, thereby achieving optimal control and saving operation time in the composite conditions of the engine.

Details of one or more embodiments of the present disclosure are set forth in the following figures and description to make other features, objects and advantages of the present disclosure more concise.

BRIEF DESCRIPTION OF THE DRAWINGS

The drawings illustrated herein are used to provide a further understanding of the present disclosure and form a part of the present disclosure, and the schematic embodiments of the present disclosure and the description thereof are used to explain the present disclosure and do not constitute an undue limitation of the present disclosure. In the drawings.

DETAILED DESCRIPTION OF THE EMBODIMENT

Figure 1:
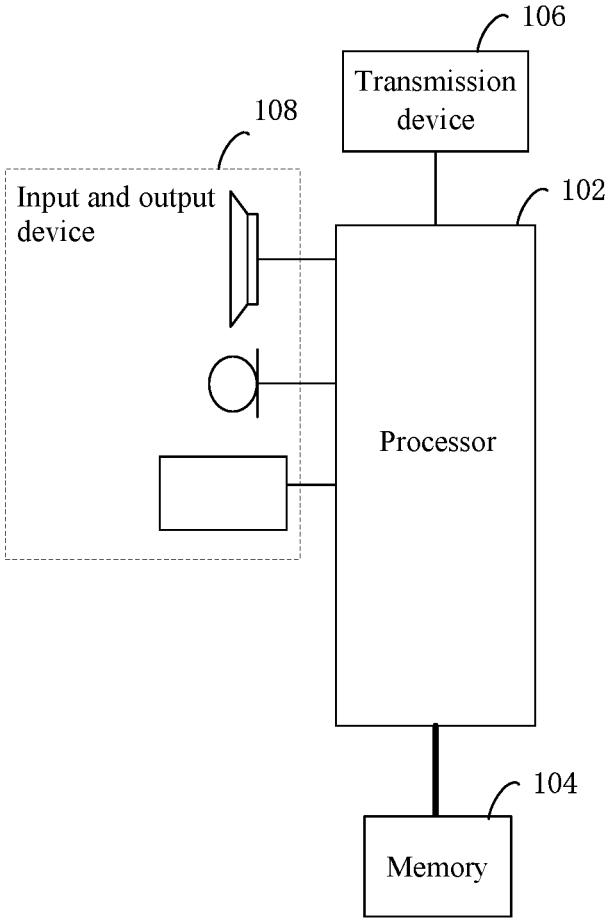
FIG. 1 is a block diagram of a hardware structure of a terminal for a control method for engine operation according to an embodiment of the present disclosure.

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the present disclosure. Based on the embodiments of the present disclosure, all other embodiments obtained by a person of ordinary skill in the art without creative efforts all belong to the scope of protection of the present disclosure.

It is apparent that the drawings in the following description are only some examples or embodiments of the present disclosure, and the present disclosure can be applied to other similar scenarios based on these drawings without creative effort to the person of ordinary skill in the art. It is also understood that, although the efforts made in such development process may be complex and lengthy, some changes like design, manufacturing or production based on the technical content disclosed in the present disclosure are only conventional technical means for the person of ordinary skill in the art related to the content disclosed in the present disclosure, and should not be construed as inadequate for the content disclosed in the present disclosure.

References to "embodiment" in the present disclosure mean that particular features, structures, or characteristics described in connection with an embodiment may be included in at least one embodiment of the present disclosure. The occurrence of the phrase at various points in the specification does not necessarily mean the same embodiment, nor is it a separate or alternative embodiment that is mutually exclusive with other embodiments. It is understood, both explicitly and implicitly, by the person of ordinary skill in the art that the embodiments described in the present disclosure may be combined with other embodiments without conflict.

Unless otherwise defined, the technical terms or scientific terms involved in the present disclosure shall have the ordinary meaning as understood by the person of ordinary skill in the art to which the present disclosure belongs. The terms "one", "a", "an", "the" and similar terms used in the present disclosure do not indicate a quantitative limitation, and can mean/connote/include singular or plural. The terms "include", "comprise", "have" and any variation thereof, as used in the present disclosure, are intended to cover non-exclusive encompassment. For example, a process, a method, a system, a product, or a device that includes a series of steps or modules (units) is not limited to the listed steps or modules (units), but may also include steps or modules (units) that are not listed, or may also include other steps or modules (units) that are inherent to the process, the method, the product or the device. The terms "connection", "connected", "coupled" and similar terms used in the present disclosure are not limited to physical or mechanical connections, but may include electrical connections directly or indirectly. The term "plurality" as used in the present disclosure refers to two or more. The word "at least one of" describes the relationship of the associated objects and indicates that three relationships can exist, for example, "at least one of A and B" can indicate the presence of A alone, A and B together, and B alone. The terms "first", "second", "third", etc. in the present disclosure are only to distinguish similar objects, and do not represent a specific ordering of objects.

According to an embodiment, a method provided in the present disclosure can be executed in a terminal, a computer, or similar computing devices. As an example of executing the method in a terminal, FIG. 1 is a block diagram of a hardware structure of a terminal for a control method for engine operation according to an embodiment of the present disclosure. As shown in FIG. 1, the terminal may include one or more (only one is shown in FIG. 1) processors 102 and a memory 104 for storing data. The processors 102 may include, but are not limited to, processing devices such as MCUs or FPGAs. Optionally, the terminal may also include transmission devices 106, and input and output devices 108 for communication. A person of ordinary skill in the art can understand that the structure shown in FIG. 1 is only for illustration, and is not intended to limit the structure of the above-mentioned terminal. For example, the terminal may also include more or fewer components than that shown in FIG. 1, or may have a different configuration from that shown in FIG. 1.

The memory 104 may be used to store computer programs, for example, software programs and modules for application software, such as the computer program corresponding to the control method for engine operation in embodiments of the present disclosure. The processor 102 performs various functional applications as well as data processing by executing the computer programs stored in the memory 104, so as to implement the method described above. The memory 104 may include a high-speed random memory and may also include a non-transitory memory, such as one or more magnetic storage devices, flash memories, or other non-transitory solid state memories. In some embodiments, the memory 104 may further include a memory that is remotely located relative to the processor 102, and the remote memory may be connected to the terminal via networks. The networks may include, but are not limited to, the internet, an intranet, a local area network, a mobile communication network, and combination thereof.

The transmission device 106 is used to receive or send data via a network. Specifically, the network described here may include a wireless network provided by communication provider for the terminal. In an embodiment, the transmission device 106 may include a Network Interface Controller (NIC) that can be connected to other network devices via a base station so that it can communicate with the internet. In an embodiment, the transmission device 106 may be a Radio Frequency (RF) module that is used to communicate with the internet wirelessly.

Figure 2:
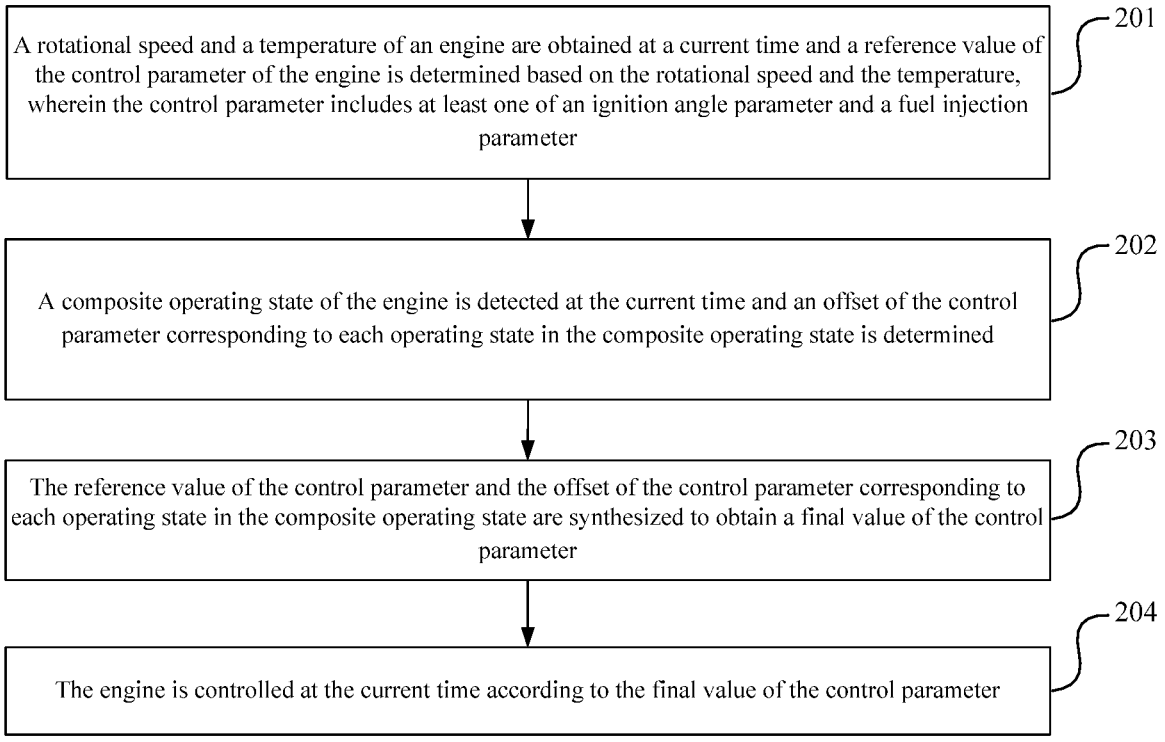
FIG. 2 is a flowchart diagram of a control method for engine operation according to an embodiment of the present disclosure.

This embodiment provides a control method for engine operation. FIG. 2 is a flowchart diagram of a control method for engine operation according to the embodiment of the present disclosure. As shown in FIG. 2, the flowchart may include the following steps:

At step 201, a rotational speed and a temperature of an engine are obtained at a current time and a reference value of the control parameter of the engine is determined based on the rotational speed and the temperature, wherein the control parameter includes at least one of an ignition angle parameter and a fuel injection parameter.

In the present embodiment, after the rotational speed and temperature of the engine at the current time are detected, a base table of speed-temperature-ignition angle and a base table of speed-temperature-fuel injection are used to look up an ignition angle reference value and a fuel injection reference value of engine operation. The base table of speed-temperature-ignition angle and the base table of speed-temperature-fuel injection include ignition angles and fuel injections experimentally measured with preset parameters. In a practical measurement, trial parameters (rotational speed and temperature) may be given, and then the ignition angles and the fuel injections may be determined according to the operation condition and the emission condition during the engine operation.

Checking the operation condition and the emission condition during the engine operation includes checking whether a fuel consumption, an emission data of an emitter, a torque output and a rotational speed fluctuation meet an engine criteria. If the criteria is met, the reference value of the control parameter corresponding to the preset parameter is determined. Then the reference value of the control parameter is written into the base table of speed-temperature-ignition angle and the base table of speed-temperature-fuel injection at a position corresponding to the preset parameter.

At step 202, a composite operating state of the engine is detected at the current time and an offset of the control parameter corresponding to each operating state in the composite operating state is determined.

In the present embodiment, the offset to be added is determined based on one or more operating states contained in the composite operating state at the current time. Each operating state in the composite operating state is non-independent and has a different offset. By determining the offset of the control parameter corresponding to each operating state, the offset to be added corresponding to the composite operating state at the current time can be determined.

At step 203, the reference value of the control parameter and the offset of the control parameter corresponding to each operating state in the composite operating state are added to obtain a final value of the control parameter.

In the present embodiment, the reference value of the control parameter and the added offset corresponding to the composite operating state are added to obtain the final value of the control parameter, which in turn determines the final desired ignition time (ignition angle) and ratio of air to fuel (injection) of the combustible mixture.

At step 204, the engine is controlled at the current time according to the final value of the control parameter.

By means of step 201 to step 204 above, the rotational speed and the temperature of the engine are obtained at the current time and the reference value of the control parameter of the engine is determined based on the rotational speed and the temperature. The composite operating state of the engine is detected at the current time and the offset of the control parameter corresponding to each operating state in the composite operating state is determined. The reference value of the control parameter and the offset of the control parameter corresponding to each operating state in the composite operating state are added to obtain the final value of the control parameter. The engine is controlled at the current time according to the final value of the control parameter. The problems of unstable operation, poor combustion and insufficient power of the engine under the composite operating conditions have been solved. By adding the reference value with offsets in multiple operating state, the ignition time and ratio of air to fuel of the final desired combustible mixture are determined to achieve optimal control under the composite operating conditions. At the same time, the offsets in multiple operating states are added and the engine is controlled based on the final value of the control parameter, thereby saving operation time, avoiding a time lag caused by cumbersome operation sequences or steps, and improving user experience.

In some embodiments, determining the reference value of the control parameter of the engine based on the rotational speed and the temperature includes the following steps:

A first table of preset control parameters is obtained, wherein the first table includes correspondence information among the rotational speed of the engine, the temperature of the engine, and the reference value of the control parameter of the engine.

In the present embodiment, the first table of preset control parameter is obtained by experimental measurements in advance, i.e. the described base table of speed-temperature-ignition angle.

The reference value of the control parameter under the rotational speed and the temperature is looked up in the first table.

The first table of preset control parameter is obtained. The reference value of the control parameter under the rotational speed and the temperature is looked up in the first table, thereby implementing looking up a reference value of the control parameter for the engine operation by the first table of preset control parameter, i.e., looking up and obtaining the ignition angle reference value and the fuel injection reference value.

In some embodiments, the composite operating state includes a first operating state. Determining an offset of the control parameter corresponding to each operating state in the composite operating state includes the following steps:

A second table of preset control parameters is obtained, wherein the second table includes correspondence information among the rotational speed of the engine, the temperature of the engine, and the offset of the control parameter of the engine under the first operating state.

In the present embodiment, the second table of preset control parameter is also a reference table generated through preset experimental measurement, and the second table of preset control parameter is associated with a mapping relationship among the rotational speed, the cylinder temperature of the engine, and engine offset.

The offset of the control parameter corresponding to the first operating state under the rotational speed and the temperature at the current time is looked up in the second table.

In the present embodiment, the first operating state includes a start up state of the engine, a cold engine state of the engine and an accelerating state of the engine. The offsets of multiple operating states are looked up in the second table.

The second table of preset control parameter is obtained. The offset of the control parameter corresponding to the first operating state under the rotational speed and the temperature is looked up in the second table, thereby implementing determining the offset of the control parameter corresponding to each operating state in the composite operating state.

In some embodiments, detecting the composite operating state of the engine at the current time includes the following steps:

A first number of revolutions from a start of the engine to the current time is detected.

Whether the first number of revolutions is less than a first preset number of revolutions is determined, wherein the first preset number of revolutions represents the number of revolutions required for the engine from the start of the engine to an exit from a start-up state.

When the first number of revolutions is less than the first preset number of revolutions, it is determined that the composite operating state of the engine includes the start-up state at the current time.

A first number of revolutions from a start of the engine to the current time is detected. Whether the first number of revolutions is less than a first preset number of revolutions is determined, when the first number of revolutions is less than the first preset number of revolutions, it is determined that the composite operating state of the engine includes the start-up state at the current time, implementing a confirmation that the engine is in the start-up state at the current time.

Figure 3:
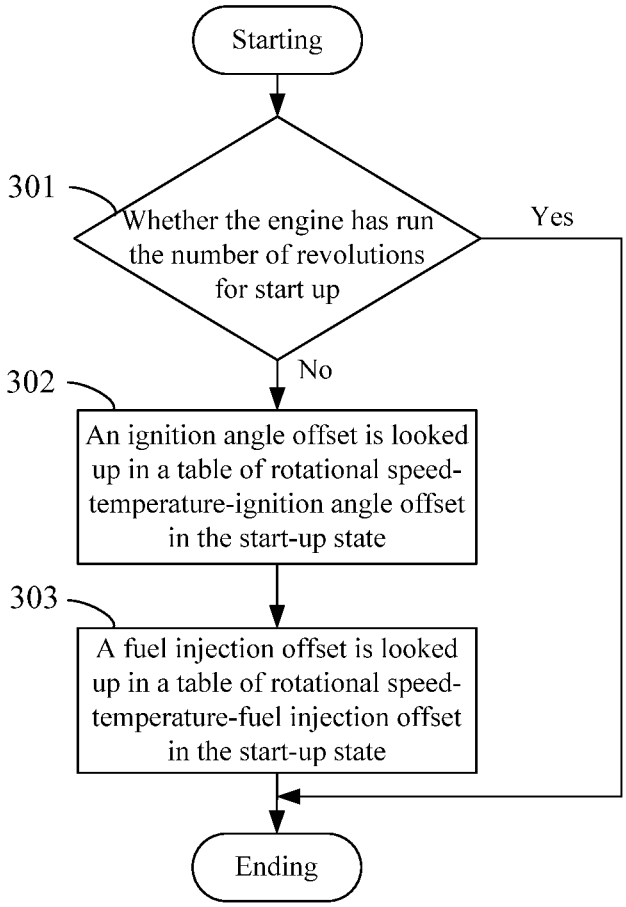
FIG. 3 is a flowchart diagram of operation control of the engine in a start-up state according to an embodiment of the present disclosure.

FIG. 3 is a flowchart diagram of operation control of the engine in a start-up state according to an embodiment of the present disclosure. As shown in FIG. 3, the flowchart may include the following steps:

At step 301, whether the engine has run the number of revolutions for startup is determined, and if not, step 302 is performed.

At step 302, an ignition angle offset is looked up and obtained in the second table of preset control parameter, and then step 303 is performed.

At step 303, a fuel injection offset is looked up and obtained in the second table of preset control parameter.

The second table of preset control parameter includes a table of rotational speed-temperature-ignition angle offset in the start-up state and a table of rotational speed-temperature-fuel injection offset in the start-up state.

By means of step 301 to step 303 described above, a detection of the offset of the engine in the start-up state is implemented.

In some embodiments, detecting the composite operating state of the engine at the current time includes the following steps:

A second preset number of revolutions corresponding to the temperature is determined, wherein the second preset number of revolutions represents the number of revolutions required for the engine at the temperature from a start of the engine to an exit from a cold engine state.

A first number of revolutions from the start of the engine to the current time is detected. The number of revolutions at the current time is calculated by the temperature at the current time.

When the first number of revolutions is less than the second preset number of revolutions, it is determined that the composite operating state of the engine includes the cold engine state at the current time.

In the present embodiment, after the engine begins to operate, the temperature inside the engine cylinder is indirectly reflected by measured temperature inside an igniter, i.e. the temperature inside the cylinder is measured by measuring a temperature of a silicon steel wafer connected to the engine cylinder on the igniter, and the number of revolutions required from the start of the engine at a certain temperature to the exit from the cold engine state is obtained by looking up the table with the temperature inside the cylinder. The second preset number of revolutions is a plurality of revolutions corresponding to a certain cold engine temperature obtained by measuring the temperature at which the engine starts, measuring the temperature at the time of the exit from the cold engine state, and counting the number of revolutions from the start of engine to the exit from a preset cold machine state.

Figure 4:
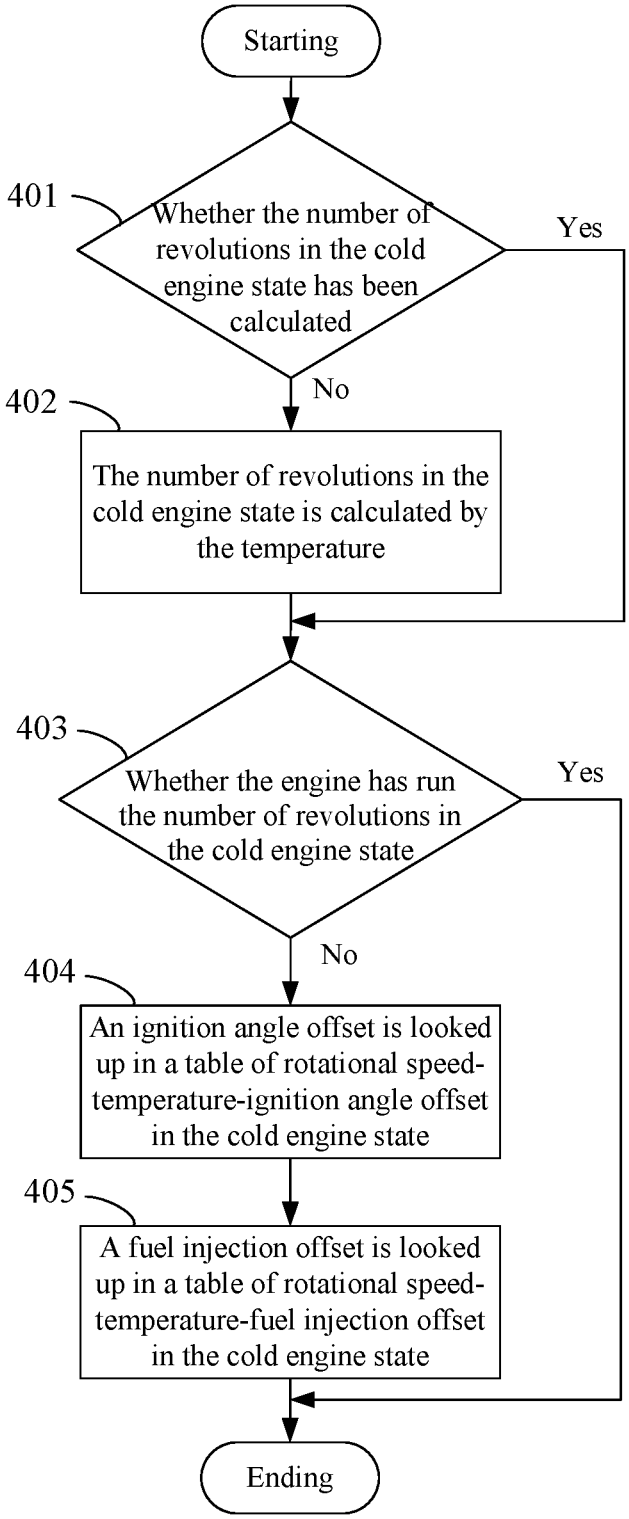
FIG. 4 is a flowchart diagram of operation control of the engine in a cold engine state according to an embodiment of the present disclosure.

FIG. 4 is a flowchart diagram of operation control of the engine in a cold engine state according to an embodiment of the present disclosure. As shown in FIG. 4, the flowchart may include the following steps:

At step 401, whether the number of revolutions in the cold engine state has been calculated is determined, if yes, step 403 is performed; otherwise, step 402 is performed.

At step 402, the number of revolutions in the cold engine state is calculated by the temperature (cylinder temperature), and then step 403 is performed.

At step 403, whether the engine has run the number of revolutions in the cold engine state is determined, and if yes, ending; otherwise, step 404 is performed.

In the present embodiment, the number of revolutions in the cold engine state includes actual number of revolutions calculated by the temperature. A judged threshold value is experimentally measured, i.e., the second preset number of revolutions described above.

At step 404, an ignition angle offset is looked up in the second table of preset control parameter, and then step 405 is performed.

At step 405, a fuel injection offset is looked up in the second table of preset control parameter.

The second table of preset control parameter includes a table of rotational speed-temperature-ignition angle offset in the cold engine state and a table of rotational speed-temperature-fuel injection offset in the cold engine state.

By means of step 401 to step 405 described above, implementing detection of the offset of the engine in the cold engine state.

In some embodiments, detecting the composite operating state of the engine at the current time includes the following steps:

Whether the acceleration of the engine at the current time meets a preset accelerating threshold and whether the engine is in an accelerating state are determined.

When the acceleration of the engine at the current time meets a preset accelerating threshold and the engine is not in the accelerating state, it is determined that the engine begins to enter the accelerating state.

In the present embodiment, several consecutive rotational speeds of the engine before the current time are collected, and the acceleration at the current time is obtained by measuring the rotational speed difference between two adjacent rotational speeds. Before the current time, there are at least four rotational speeds collected and at least three rotational speed differences calculated. When the rotational speed differences exceed the preset threshold twice or more in a row, it is judged that the engine enters the accelerating state. At the same time, since the accelerating state cannot be engaged frequently, after entering the accelerating state once, a plurality of revolutions need to be run before the next accelerating state can be judged.

In some embodiments, after it is determined that the engine begins to enter the accelerating state, detecting the composite operating state of the engine at the current time includes the following steps:

A second number of revolutions from entering the accelerating state to the current time is detected.

Whether the second number of revolutions is greater than a third preset number of revolutions is determined, wherein the third preset number of revolutions represents the number of revolutions required for the engine from entering the accelerating state to an exit from the accelerating state.

When the second number of revolutions is greater than the third preset number of revolutions, it is determined that the engine exits the accelerating state.

In the present embodiment, the third preset number of revolutions is measured experimentally in practice. Specifically, when a certain engine acts best by exiting the accelerating state in a preset speed range, the third preset number of revolutions is determined by testing the number of revolutions required for the acceleration from different low speed to that in the preset speed range.

At the same time, in order to avoid the engine suddenly decelerating to cause the engine to stall, the rotational speed needs to last for a period of time to decelerate from the high speed to the low speed. The period of time is longer than a corresponding time for the rotational speed to accelerate from the low speed to the high speed. The period of time is associated with the speed of rotational speed decline, and if the deceleration is fast, the period of time needs to be long. Therefore, this disclosure is designed to determine whether the acceleration offset is added by the number of operating revolutions. When the number of operating revolutions is greater than the number of accelerating revolutions (the third preset number of revolutions), it means that the engine has completed this accelerating state and it can enter the judgment of the next accelerating state.

In some embodiments, the third preset number of revolutions is determined based on the acceleration at which the engine begins to enter the accelerating state, the rotational speed at which the engine begins to enter the accelerating state, and the target rotational speed of the engine.

In some embodiments, detecting the composite operating state of the engine at the current time the includes the following steps:

When the second number of revolutions is not greater than the third preset number of revolutions, it is determined that the composite operating state of the engine includes the accelerating state at the current time.

Figure 5:
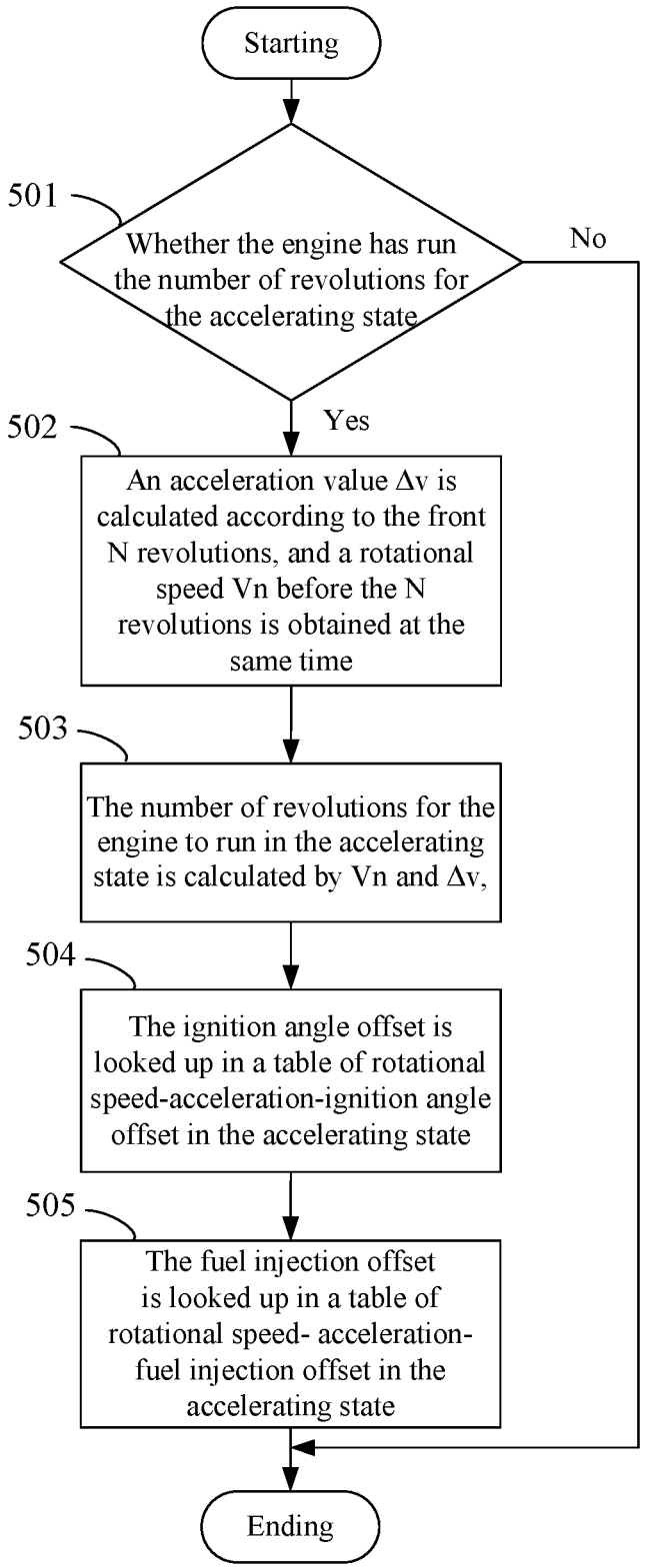
FIG. 5 is a flowchart diagram of operation control of the engine in an accelerating state according to an embodiment of the present disclosure.

FIG. 5 is a flowchart diagram of operation control of the engine in an accelerating state according to an embodiment of the present disclosure. As shown in FIG. 4, the flowchart may include the following steps:

At step 501, whether the engine has run the number of revolutions for the accelerating state is determined, if yes, step 502 is performed; otherwise, the engine is kept in the current accelerating state.

In the present embodiment, whether the engine is still in the accelerating state is determined by detecting the number of revolutions that the engine has run, thereby avoiding the engine from frequently participating in the accelerating state.

At step 502, an acceleration value Δv is calculated according to the front N revolutions, and a rotational speed Vn before the N revolutions is obtained at the same time, and then step 503 is performed.

In the present embodiment, the acceleration value Δv is generated according to the rotational speed Vn before N revolutions, i.e. the acceleration value is determined by the rotational speed difference between two adjacent rotational speeds, and it is determined by the acceleration value that whether the engine is in the accelerating state.

At step 503, the number of revolutions for the engine to run in the accelerating state is calculated by Vn and Δv, and then step 504 is performed.

In the present embodiment, the number of revolutions for the engine to run in the accelerating state is calculated by Vn and Δv, and the number of revolutions for the engine to run in the accelerating state can be measured in advance or in real time.

At step 504, the ignition angle offset is looked up in the second table of preset control parameter, and then step S505 is performed.

At step 505, the fuel injection offset is looked up in the second table of preset control parameter.

The second table of preset control parameter includes a table of rotational speed-acceleration-ignition angle offset in the accelerating state and a table of rotational speed-acceleration-fuel injection offset in the accelerating state.

By means of step 501 to step 505 described above, implementing detection of the offset of the engine in the accelerating state.

In some embodiments, detecting a composite operating state of the engine at the current time and determining an offset of the control parameter corresponding to each operating state in the composite operating state include the following steps:

It is judged whether an adaptive-adjustment instruction is received.

Upon receipt of the adaptive-adjustment instruction, it is determined that the engine begins to enter an adaptive-adjustment state.

A ratio of air to fuel of the engine is reduced by a first preset step until a rotational speed after the reduction is less than the rotational speed before the reduction, and a rotational speed difference between the rotational speed before the reduction and the rotational speed after the reduction is greater than a preset drop value.

The ratio of air to fuel of the engine is increased by a second preset step until the rotational speed after the increase is less than the rotational speed before the increase, and a rotational speed difference between the rotational speed before the increase and the rotational speed after the increase is greater than the preset drop value.

The offset of the control parameter corresponding to the adaptive-adjustment state is determined by a reduced ratio of air to fuel and an increased ratio of air to fuel.

By means of above steps, it is implemented that obtaining an optimal fuel consumption point of the engine.

In the present embodiment, the preset drop value ranges from 0-200 revolutions per minute. It should be noted that the adaptive-adjustment of the present embodiment is not allowed to be performed when the composite operating state of the engine at the current time is detected to be the accelerating state.

Figure 6:
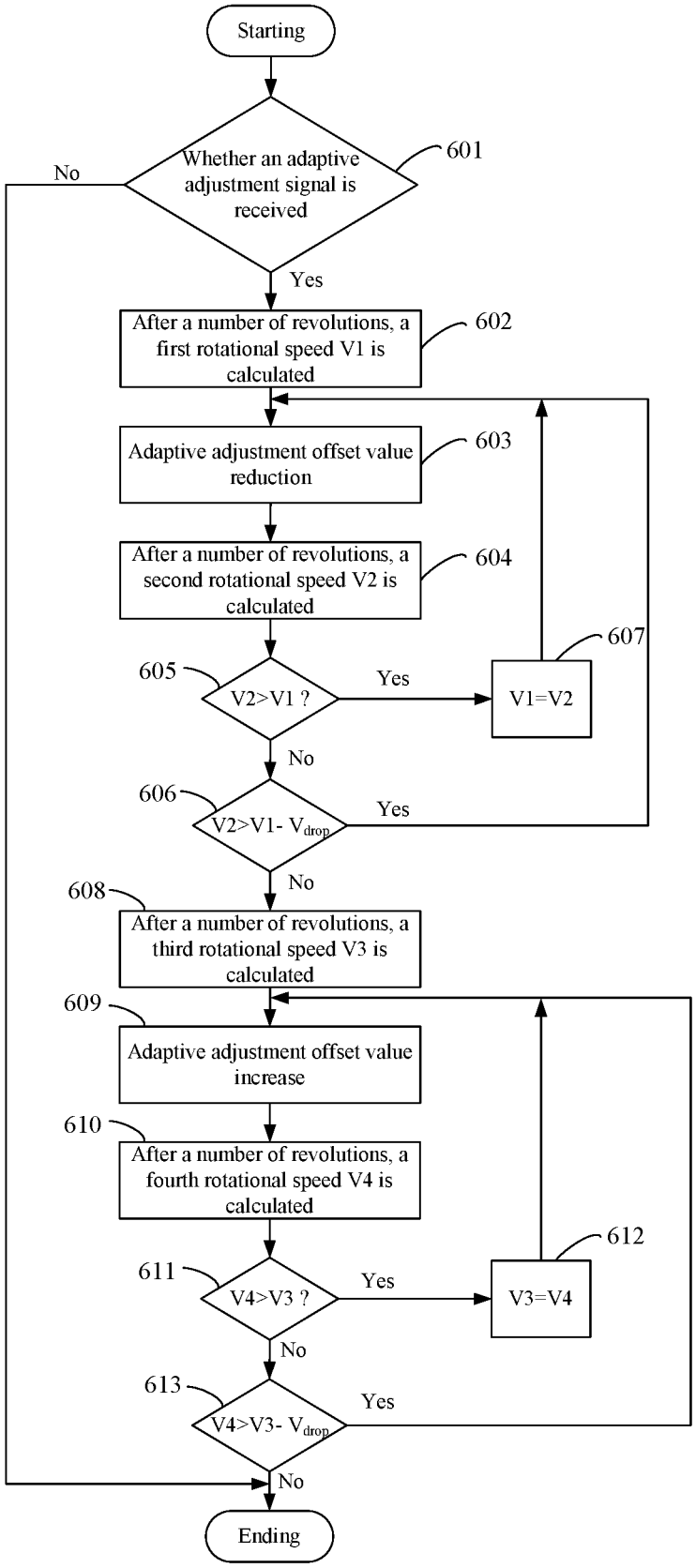
FIG. 6 is a flowchart diagram of operation control of the engine in an adaptive-adjustment state according to an embodiment of the present disclosure.

FIG. 6 is a flowchart diagram of operation control of the engine in an adaptive-adjustment state according to an embodiment of the present disclosure, and as shown in FIG. 6, the flowchart may include the following steps:

At step 601, whether an adaptive-adjustment signal is received is determined, and if yes, step 602 is performed.

At step 602, after a plurality of revolutions, a first rotational speed V1 is calculated, and then step 603 is performed.

At step 603, an opening degree of a solenoid valve is controlled, a ratio of air to fuel is reduced, and then step 604 is performed.

At step 604, after a plurality of revolutions, a second rotational speed V2 is calculated, and then step 605 is performed.

At step 605, comparing the second rotational speed and the first rotational speed, if the second rotational speed is greater than the first rotational speed, step 607 is performed; otherwise, step 606 is performed.

At step 606, whether the second rotational is greater than a difference between the first rotational speed and a drop value $V_{drop}$ is determined, if yes, step 603 is performed; otherwise, step 608 is performed.

At step 607, the second rotational speed is taken as the first rotational speed, and then step 603 is performed.

At step 608, after a plurality of revolutions, a third rotational speed V3 is calculated, and then step 609 is performed.

At step 609, the opening degree of the solenoid valve is controlled and the ratio of air to fuel is increased, and then step 610 is performed.

At step 610, after a plurality of revolutions, a fourth rotational speed V4 is calculated, and then step 611 is performed.

At step 611, comparing the fourth rotational speed V4 and the third rotational speed V3, if the fourth rotational speed V4 is greater than the third rotational speed V3, step 612 is performed; otherwise, step 613 is performed.

At step 612, the fourth rotational speed V4 is taken as the third rotational speed V3, and then step 609 is performed.

At step 613, whether the fourth rotational V4 is greater than a difference between the third rotational speed V3 and the drop value $V_{drop}$ is determined, if yes, step 609 is performed; otherwise, the adaptive-adjustment is completed.

By means of step 601 to step 612 described above, the optimal fuel consumption point of the engine can be found.

Figure 7:
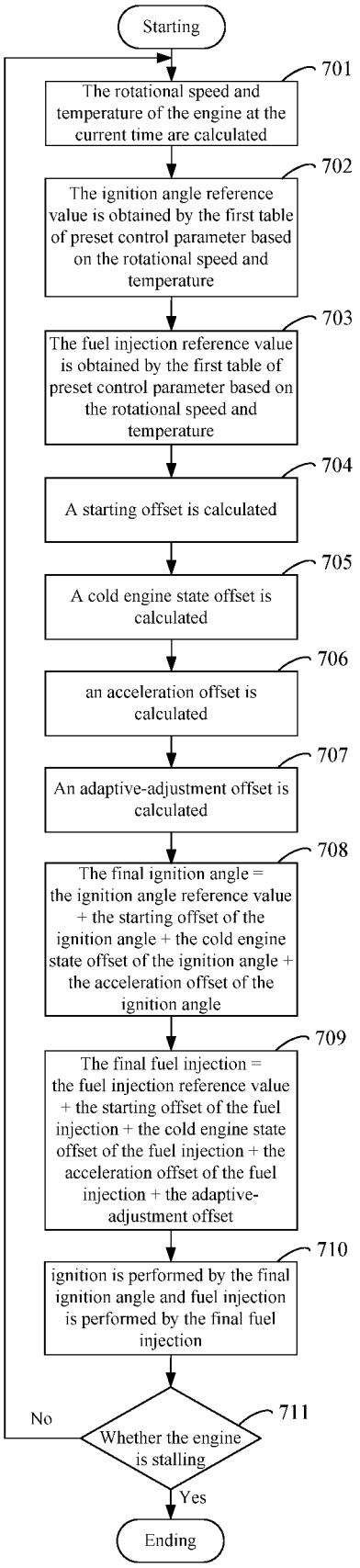
FIG. 7 is a flowchart diagram of a control method for engine operation according to an embodiment of the present disclosure.

FIG. 7 is a flowchart diagram of a control method for engine operation according to an embodiment of the present disclosure, and as shown in FIG. 7, the flowchart may include the following steps:

At step 701, the rotational speed and temperature of the engine at the current time are calculated.

At step 702, the ignition angle reference value is obtained by the first table of preset control parameter based on the rotational speed and temperature, wherein the ignition angle reference value in the first table of preset control parameter is experimentally measured.

At step 703, the fuel injection reference value is obtained by the first table of preset control parameter based on the rotational speed and temperature.

At step 704, a starting offset is calculated.

At step 705, a cold engine state offset is calculated.

At step 706, an acceleration offset is calculated.

At step 707, an adaptive-adjustment offset is calculated.

At step 708, the final ignition angle is determined by the ignition angle reference value, the starting offset of the ignition angle, the cold engine state offset of the ignition angle and the acceleration offset of the ignition angle.

At step 709, the final fuel injection is determined by the fuel injection reference value, the starting offset of the fuel injection, the cold engine state offset of the fuel injection, the acceleration offset of the fuel injection and the adaptive-adjustment offset.

At step 710, ignition is performed by the final ignition angle and fuel injection is performed by the final fuel injection.

At step 711, whether the engine is stalling is determined, if yes, stopping, otherwise, step 701 is performed.

It should be noted that, the steps shown in the foregoing flowchart or the flowchart of the drawings may be performed in a computer system which includes a set of computer executable instructions. Although a logical order is shown in the flowchart diagram, in some cases, the steps shown or described may be performed in an order different from that here.

The present embodiment further provides a control device for engine operation, and the control device is configured to implement the described embodiments and optional implementations, and the description thereof is omitted. As used below, the terms "module", "unit", "sub-unit", etc. may implement at least one of a combination of software and hardware of a predetermined function. Although the device described in the following embodiments is preferably implemented in software, implementation of hardware, or a combination of software and hardware is also possible and contemplated.

Figure 8:
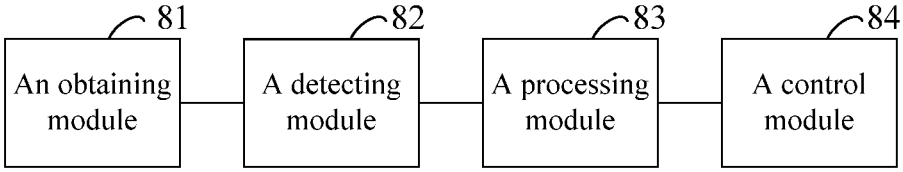
FIG. 8 is a block diagram of a structure of a control device for engine operation according to an embodiment of the present disclosure.

FIG. 8 is a block diagram of a structure of a control device for engine operation according to an embodiment of the present disclosure. As shown in FIG. 8, the control device includes:

An obtaining module 81, configured to obtain a rotational speed and a temperature of an engine at a current time and determine a reference value of the control parameter of the engine based on the rotational speed and the temperature, wherein the control parameter includes at least one of an ignition angle parameter and a fuel injection parameter.

A detecting module 82, coupled to the obtaining module 81, configured to detect a composite operating state of the engine at the current time and determine an offset of the control parameter corresponding to each operating state in the composite operating state.

A processing module 83, coupled to the detecting module 82, configured to add the reference value of the control parameter and the offset of the control parameter corresponding to each operating state in the composite operating state to obtain a final value of the control parameter.

A control module 84, coupled to the processing module 83, configured to control the engine at the current time according to the final value of the control parameter.

In some embodiments, the obtaining module 81 is configured to obtain a first table of preset control parameters and look up the reference value of the control parameter under the rotational speed and the temperature in the first table.

In some embodiments, the composite operating state includes a first operating state. The detecting module 82 is configured to obtain a second table of preset control parameters and look up the offset of the control parameter corresponding to the first operating state under the rotational speed and the temperature in the second table.

In some embodiments, the detecting module 82 is configured to detect a first number of revolutions from a start of the engine to the current time, and judge whether the first number of revolutions is less than a first preset number of revolutions, wherein the first preset number of revolutions represents the number of revolutions required for the engine from the start of the engine to an exit from a start-up state. The detecting module 82 is configured to determine that the composite operating state of the engine includes the start-up state at the current time when the first number of revolutions is less than the first preset number of revolutions.

In some embodiments, the detecting module 82 is configured to determine a second preset number of revolutions corresponding to the temperature, wherein the second preset number of revolutions represents the number of revolutions required for the engine at the temperature from a start of the engine to an exit from a cold engine state. The detecting module 82 is configured to detect a first number of revolutions from the start of the engine to the current time, and determine that the composite operating state of the engine includes the cold engine state at the current time when the first number of revolutions is less than the second preset number of revolutions.

In some embodiments, the detecting module 82 is configured to judge whether the acceleration of the engine at the current time meets a preset accelerating threshold and whether the engine is in an accelerating state, and determine that the engine begins to enter the accelerating state when the acceleration of the engine at the current time meets a preset accelerating threshold and the engine is not in the accelerating state.

In some embodiments, the detecting module 82 is configured to detect a second number of revolutions from entering the accelerating state to the current time after determining that the engine begins to enter the accelerating state, and judge whether the second number of revolutions is greater than a third preset number of revolutions, wherein the third preset number of revolutions represents the number of revolutions required for the engine from entering the accelerating state to an exit from the accelerating state. The detecting module 82 is configured to determine that the engine exits the accelerating state when the second number of revolutions is greater than the third preset number of revolutions.

In some embodiments, the detecting module 82 is configured to determine that the composite operating state of the engine includes the accelerating state at the current time when the second number of revolutions is not greater than the third preset number of revolutions.

In some embodiments, the detecting module 82 is configured to judge whether an adaptive-adjustment instruction is received. Upon receipt of the adaptive-adjustment instruction, the detecting module 82 is configured to determine that the engine begins to enter an adaptive-adjustment state, and reduce a ratio of air to fuel of the engine by a first preset step until a rotational speed after the reduction is less than the rotational speed before the reduction, and a rotational speed difference between the rotational speed before the reduction and the rotational speed after the reduction is greater than a preset drop value.

The detecting module 82 is configured to increase the ratio of air to fuel of the engine by a second preset step until the rotational speed after the increase is less than the rotational speed before the increase, and a rotational speed difference between the rotational speed before the increase and the rotational speed after the increase is greater than the preset drop value.

The detecting module 82 is configured to determine the offset of the control parameter corresponding to the adaptive-adjustment state according to a reduced ratio of air to fuel and an increased ratio of air to fuel.

The present embodiment further provides an electronic device, including a memory and a processor, wherein the memory stores a computer program, and the processor is configured to execute the computer program to implement the steps in any of the foregoing method embodiments.

Optionally, the above electronic device may further include a transmission device and an input and output device, wherein the transmission device is connected to the above processor and the input and output device is connected to the above processor.

Optionally, in the present embodiment, the above processor may be set to execute the following steps by means of a computer program:

At step 1, a rotational speed and a temperature of an engine are obtained at a current time and a reference value of the control parameter of the engine is determined based on the rotational speed and the temperature, wherein the control parameter includes at least one of an ignition angle parameter and a fuel injection parameter.

At step 2, a composite operating state of the engine is detected at the current time and an offset of the control parameter corresponding to each operating state in the composite operating state is determined.

At step 3, the reference value of the control parameter and the offset of the control parameter corresponding to each operating state in the composite operating state are added to obtain a final value of the control parameter.

At step 4, the engine is controlled at the current time according to the final value of the control parameter.

It should be noted that, specific examples in the present embodiment may refer to the examples described in the above embodiments and optional implementations, and the present embodiment will not be repeated herein.

Further, in conjunction with the control method for engine operation in the above embodiments, the present embodiments may provide a storage medium to implement the method. The storage medium has a computer program stored thereon, and the computer program implements any of the control methods for engine operation of the above embodiments when executed by a processor.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a plurality of variations and modifications may be made by those skilled in the art without departing from the spirit and scope of the disclosure. Therefore, the scope of the disclosure should be determined by the appended claims.

We claim:

1. A control method for engine operation, wherein the method comprises:

obtaining a rotational speed and a temperature of an engine at a current time and determining a reference value of the control parameter of the engine based on the rotational speed and the temperature, wherein the control parameter comprises at least one of an ignition angle parameter and a fuel injection parameter;

detecting a composite operating state of the engine at the current time and determining an offset of the control parameter corresponding to each operating state in the composite operating state;

adding the reference value of the control parameter and the offset of the control parameter corresponding to each operating state in the composite operating state to obtain a final value of the control parameter; and controlling the engine at the current time according to the final value of the control parameter.

2. The method of claim 1, wherein the determining a reference value of the control parameter of the engine based on the rotational speed and the temperature comprises:

obtaining a first table of preset control parameters, wherein the first table comprises correspondence information among the rotational speed of the engine, the temperature of the engine, and the reference value of the control parameter of the engine; and looking up the reference value of the control parameter under the rotational speed and the temperature in the first table.

3. The method of claim 1, wherein the composite operating state comprises a first operating state, and the determining an offset of the control parameter corresponding to each operating state in the composite operating state comprises:

obtaining a second table of preset control parameters, wherein the second table comprises correspondence information among the rotational speed of the engine, the temperature of the engine, and the offset of the control parameter of the engine under the first operating state; and looking up the offset of the control parameter corresponding to the first operating state under the rotational speed and the temperature in the second table.

4. The method of claim 1, wherein the detecting a composite operating state of the engine at the current time comprises:

detecting a first number of revolutions from a start of the engine to the current time;

judging whether the first number of revolutions is less than a first preset number of revolutions, wherein the first preset number of revolutions represents the number of revolutions required for the engine from the start of the engine to an exit from a start-up state; and when the first number of revolutions is less than the first preset number of revolutions, determining that the composite operating state of the engine comprises the start-up state at the current time.

5. The method of claim 1, wherein the detecting a composite operating state of the engine at the current time comprises:

determining a second preset number of revolutions corresponding to the temperature, wherein the second preset number of revolutions represents the number of revolutions required for the engine at the temperature from a start of the engine to an exit from a cold engine state;

detecting a first number of revolutions from the start of the engine to the current time; and when the first number of revolutions is less than the second preset number of revolutions, determining that the composite operating state of the engine comprises the cold engine state at the current time.

6. The method of claim 1, wherein the detecting a composite operating state of the engine at the current time comprises:

judging whether the acceleration of the engine at the current time meets a preset accelerating threshold and whether the engine is in an accelerating state; and when the acceleration of the engine at the current time meets a preset accelerating threshold and the engine is not in the accelerating state, determining that the engine begins to enter the accelerating state.

7. The method of claim 6, wherein after the determining that the engine begins to enter the accelerating state, the detecting a composite operating state of the engine at the current time further comprises:

detecting a second number of revolutions from entering the accelerating state to the current time;

judging whether the second number of revolutions is greater than a third preset number of revolutions, wherein the third preset number of revolutions represents the number of revolutions required for the engine from entering the accelerating state to an exit from the accelerating state; and when the second number of revolutions is greater than the third preset number of revolutions, determining that the engine exits the accelerating state.

8. The method of claim 7, wherein the third preset number of revolutions is determined based on the acceleration at which the engine begins to enter the accelerating state, the rotational speed at which the engine begins to enter the accelerating state, and the target rotational speed of the engine.

9. The method of claim 7, wherein the detecting a composite operating state of the engine at the current time further comprises:

when the second number of revolutions is not greater than the third preset number of revolutions, determining that the composite operating state of the engine comprises the accelerating state at the current time.

10. The method of claim 1, wherein the detecting a composite operating state of the engine at the current time and determining an offset of the control parameter corresponding to each operating state in the composite operating state further comprises:

judging whether an adaptive-adjustment instruction is received;

upon receipt of the adaptive-adjustment instruction, determining that the engine begins to enter an adaptive-adjustment state;

reducing a ratio of air to fuel of the engine by a first preset step until a rotational speed after the reduction is less than the rotational speed before the reduction, and a rotational speed difference between the rotational speed before the reduction and the rotational speed after the reduction is greater than a preset drop value;

increasing the ratio of air to fuel of the engine by a second preset step until the rotational speed after the increase is less than the rotational speed before the increase, and a rotational speed difference between the rotational speed before the increase and the rotational speed after the increase is greater than the preset drop value; and determining the offset of the control parameter corresponding to the adaptive-adjustment state according to a reduced ratio of air to fuel and an increased ratio of air to fuel.

11. The method of claim 10, wherein the preset drop value ranges from 0-200 revolutions per minute.

12. An electronic device, comprising a memory and a processor, wherein the memory stores a computer program, and the processor is configured to execute the computer program to implement a control method for engine operation comprising:

obtaining a rotational speed and a temperature of an engine at a current time and determining a reference value of the control parameter of the engine based on the rotational speed and the temperature, wherein the control parameter comprises at least one of an ignition angle parameter and a fuel injection parameter;

detecting a composite operating state of the engine at the current time and determining an offset of the control parameter corresponding to each operating state in the composite operating state;

adding the reference value of the control parameter and the offset of the control parameter corresponding to each operating state in the composite operating state to obtain a final value of the control parameter; and controlling the engine at the current time according to the final value of the control parameter.

13. The electronic device of claim 12, wherein the control method further comprises:

obtaining a first table of preset control parameters, wherein the first table comprises correspondence information among the rotational speed of the engine, the temperature of the engine, and the reference value of the control parameter of the engine; and looking up the reference value of the control parameter under the rotational speed and the temperature at the current time in the first table.

14. The electronic device of claim 12, wherein the control method further comprises:

obtaining a second table of preset control parameters, wherein the second table comprises correspondence information among the rotational speed of the engine, the temperature of the engine, and the reference value of the control parameter of the engine under the first operating state; and looking up a reference value of the control parameter corresponding to the first operating state under the rotational speed and the temperature at the current time in the first table.

15. The electronic device of claim 12, wherein the control method further comprises:

detecting a first number of revolutions from a start of the engine to the current time;

judging whether the first number of revolutions is less than a first preset number of revolutions, wherein the first preset number of revolutions represents the number of revolutions required for the engine from the start of the engine to an exit from a start-up state; and when the first number of revolutions is less than the first preset number of revolutions, determining that the composite operating state of the engine comprises the start-up state at the current time.

16. The electronic device of claim 12, wherein the control method further comprises:

determining a second preset number of revolutions corresponding to the temperature, wherein the second preset number of revolutions represents the number of revolutions required for the engine at the temperature from a start of the engine to an exit from a cold engine state;

detecting a first number of revolutions from the start of the engine to the current time; and when the first number of revolutions is less than the second preset number of revolutions, determining that the composite operating state of the engine comprises the cold engine state at the current time.

17. The electronic device of claim 12, wherein the control method further comprises:

judging whether the acceleration of the engine at the current time meets a preset accelerating threshold and whether the engine is in an accelerating state; and when the acceleration of the engine at the current time meets a preset accelerating threshold and the engine is not in the accelerating state, determining that the engine begins to enter the accelerating state.

18. The electronic device of claim 17, wherein the control method further comprises:

detecting a second number of revolutions from entering the accelerating state of the engine to the current time;

judging whether the second number of revolutions is greater than a third preset number of revolutions, wherein the third preset number of revolutions represents the number of revolutions required for the engine from entering the accelerating state of the engine to an exit from the accelerating state; and when the second number of revolutions is greater than the third preset number of revolutions, determining that the engine exits the accelerating state.

19. A storage medium having stored a computer program thereon, wherein the computer program is executed by a processor to implement a control method for engine operation comprising:

obtaining a rotational speed and a temperature of an engine at a current time and determining a reference value of the control parameter of the engine based on the rotational speed and the temperature, wherein the control parameter comprises at least one of an ignition angle parameter and a fuel injection parameter;

detecting a composite operating state of the engine at the current time and determining an offset of the control parameter corresponding to each operating state in the composite operating state;

adding the reference value of the control parameter and the offset of the control parameter corresponding to each operating state in the composite operating state to obtain a final value of the control parameter; and controlling the engine at the current time according to the final value of the control parameter.

* * * * *